US009694921B2

(12) United States Patent
Oropeza

(10) Patent No.: US 9,694,921 B2
(45) **Date of Patent: *Jul. 4, 2017**

(54) APPARATUS FOR FILLING CONTAINERS

(71) Applicant: Jesus R. Oropeza, Yuma, AZ (US)

(72) Inventor: Jesus R. Oropeza, Yuma, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/930,013

(22) Filed: Nov. 2, 2015

(65) Prior Publication Data

US 2016/0052652 A1 Feb. 25, 2016

Related U.S. Application Data

(63) Continuation of application No. 13/917,242, filed on Jun. 13, 2013, now Pat. No. 9,193,484, which is a continuation of application No. 13/632,389, filed on Oct. 1, 2012, now Pat. No. 8,485,232.

(51) Int. Cl.

| | |
|---|---|
| ***B65B 1/24*** | (2006.01) |
| ***B65B 25/04*** | (2006.01) |
| ***B65B 39/00*** | (2006.01) |

(52) U.S. Cl.

CPC ..... *B65B 1/24* (2013.01); *B65B 25/04* (2013.01); *B65B 39/00* (2013.01)

(58) Field of Classification Search

CPC ..... B65B 1/24; B65B 25/04; B65B 39/00
USPC ..... 141/73, 81, 249, 258, 264, 320–323; 53/527, 529; 100/215, 226, 227, 229; 222/389

See application file for complete search history.

(56) References Cited

U.S. PATENT DOCUMENTS

| | | | | |
|---|---|---|---|---|
| 3,088,499 | A | 5/1963 | Rieger | |
| 3,181,957 | A | 5/1965 | Carruthers | |
| 3,386,372 | A | 6/1968 | Karl-Heinz | |
| 3,476,037 | A | 11/1969 | Gorby | |
| 3,501,890 | A | 3/1970 | Hunt | |
| 3,563,168 | A | 2/1971 | Doninger | |
| 3,589,277 | A | 6/1971 | Gray et al. | |
| 3,611,673 | A | 10/1971 | Carkhuff | |
| 5,046,304 | A | 9/1991 | Alameda et al. | |
| 5,401,156 | A | 3/1995 | Anderson | |
| 5,987,857 | A | 11/1999 | Haddow et al. | |
| 6,390,330 | B2 | 5/2002 | Runft | |
| 7,051,771 | B2 | 5/2006 | Ede et al. | |
| 7,363,954 | B2 | 4/2008 | Sleiman et al. | |
| 8,485,232 | B1 * | 7/2013 | Oropeza | B65B 1/24 100/226 |
| 8,683,920 | B1 * | 4/2014 | Oropeza | B30B 9/3042 100/215 |

(Continued)

OTHER PUBLICATIONS

Office Action dated Dec. 17, 2012 in U.S. Appl. No. 13/632,389.

(Continued)

*Primary Examiner* — Timothy L Maust
(74) *Attorney, Agent, or Firm* — Snell & Wilmer L.L.P.

(57) ABSTRACT

The present invention relates, generally, to a method and apparatus for filling and/or tamping product in a container. More specifically, the present disclosure is related to a device for filling a container with a material including a conduit comprising a top opening and a bottom opening, and a tamper integrally coupled to the conduit, wherein the tamper is configured to move laterally in a straight path horizontally, wherein a tamping face is configured to tamp in a vertical direction.

19 Claims, 12 Drawing Sheets

(56) References Cited

U.S. PATENT DOCUMENTS 9,193,484 B2 * 11/2015 Oropeza ..... B65B 1/24

OTHER PUBLICATIONS

Notice of Allowance dated May 2, 2013 in U.S. Appl. No. 13/632,389.
Supplemental Notice of Allowability dated Jun. 6, 2013 in U.S. Appl. No. 13/632,389.
Office Action dated Dec. 4, 2012 in U.S. Appl. No. 13/632,398.
Final Office Action dated Aug. 20, 2013 in U.S. Appl. No. 13/632,398.
Notice of Allowance dated Nov. 14, 2013 in U.S. Appl. No. 13/632,398.
Office Action dated Mar. 23, 2015 in U.S. Appl. No. 13/917,242.
Notice of Allowance dated Jul. 22, 2015 in U.S. Appl. No. 13/917,242.

* cited by examiner

APPARATUS FOR FILLING CONTAINERS

CROSS-REFERENCE TO RELATED APPLICATIONS

This continuation patent application claims priority to and the benefit of U.S. Ser. No. 13/917,242 filed Jun. 13, 2013 and entitled "APPARATUS FOR FILLING CONTAINERS." The '242 continuation patent application claims priority to and the benefit of U.S. Ser. No. 13/632,389 filed Oct. 1, 2012 and issued as U.S. Pat. No. 8,485,232 on Jul. 16, 2013 and entitled "APPARATUS FOR FILLING CONTAINERS." Both of the aforementioned applications are incorporated herein by reference in their entirety for any purpose.

FIELD OF INVENTION

This invention relates to a system and apparatus for filling containers, and more particularly, to a system and method directed to a container filler comprising an integral tamper.

BACKGROUND OF THE INVENTION

Although, in general, the container filling process is known, a number of deficiencies are apparent in the prior art. Most notable of these deficiencies is that the conventional industrial container filling process often results in material spillage. Spillage may be material that is intended be transferred from a first location to a container that does not arrive at its intended destination and/or arrive in the intended positioning. For instance, lettuce leaves delivered through a filler which arrive completely or partially outside of a intended container. As such, use of conventional industrial container fillers often requires downstream personnel to cure cosmetic and functional imperfections resultant from material spillage. Of course, increases of manpower needs, in turn, increase production costs and often slow the rate of production. It would be advantageous to reduce number of additional personnel utilized.

Also, conventional industrial container filler systems often employ downstream tamping systems to depress at least a portion of the material so that a lid may be coupled to the container. In this way, the material does not create an impediment to lid placement. Each downstream additional tamping system increases the overall system footprint. Moreover, each additional piece of machinery caries a cost and a potential for failure. It would be advantageous to reduce the number of these additional downstream mechanical systems.

Often times, material traveling through an industrial container filler may become temporarily caught on a structure within the filler. For instance, lettuce leaves may become adhered to an internal surface of a filler due to a slope of a surface being too flat or surface characteristics of the filler that encourage suction. This results in a production delay as the container filling process is ordinarily paused and steps are taken to remove the caught material and/or accumulated aggregate caught material. This delay increases production costs. It would be advantageous to reduce the number of production delays.

Reduction in distance between the filler bottom and the container minimizes spilling of material outside of the container. Often times if the gap between the container and the filler bottom is too small, material may make contact with the bottom of the filler as the container is advanced on the production line. This often results in spillage of the material which workers must address by hand. It would be advantageous to have a filler system which reduces material spillage.

Optimally, the motion of tamping and/or compression is in a downward direction towards the bottom of a container; however, optimally, the path of material traveling through a filler is straight down into a container with little impeding the flow of the material from a top opening to a bottom opening. As one can appreciate, these two goals have been at odds as a tamper positioned directly over the container impedes the flow of material through a vertical conduit of the filler. Conventional tampers implemented with fillers have been offset and/or configured to tamp in a less than optimal direction, such as a direction other than a vertical direction towards the bottom of a provided container. It would be advantageous to have a filler system which allows for and is configured to tamp in a direction towards the bottom of the container.

Moreover, historically, empty containers have been moved into position under the filler, filled with a material, tamped if desired and indexed forward. The time each of these steps takes impact the efficiency the container filling system. Thus, decreasing the time for any of these steps results in increased system efficiency and increased product runs. Thus, a premium is often placed on decreasing the tamper stroke time and/or tamper stroke distance. Thus, it is desirable to place the compressed tamper relatively close to the material to be tamped by the extended tamper to minimize tamper travel time. It would be advantageous to have a system which reduces tamper travel time and distance.

The present inventors have recognized that filler with integral tamper design would allow a significant increase in productivity with a decrease in system footprint, and production costs, particularly for a process where a container is filled with a material, such as vegetable (e.g. lettuce).

SUMMARY OF THE INVENTION

The present invention relates to an improved container filler and apparatus designed to address, among other things, the aforementioned deficiencies in prior art container filling systems.

While the way in which the present invention addresses these deficiencies and provides these advantages will be discussed in greater detail below, in general, the use of an integral vertical tamping system enables efficient and cost-effective container filling. Furthermore, the use of such a system reduces the need for down-stream personnel and additional downstream tamping machinery, such as downstream vertical tampers, which is advantageous. Moreover, the integral vertical tamping system can self-clear obstructions within portions of its conduit.

A filler may direct material, such as a leafy vegetable, from one location to another. In accordance with one aspect of an exemplary embodiment of the invention the filler may utilize a conduit to direct material from an opening in the filler to a container positioned below the filler. In a preferable embodiment, the filler may direct material from a first location external to a container into a second location within the container.

In accordance with one aspect of an exemplary embodiment of the invention, a tamper is integrally coupled to the filler. Due to this integral coupling, material may be filled and tamped in a container without the container being moved between the filling and tamping processes. In this way, material spillage is reduced. Tampers are utilized in the container filling industry to, among other things, compress material filled in a container.

The present integral tamper system comprises a system where a container may be moved into a position substantially under the filler to be filled with material by the filler. After the container is filled with material, without moving the container, the tamper may be moved into tamping position directly above the container without further advancement and/or movement of the container under the filler. Then, aspects of the tamper may move in a substantially vertical motion to tamp the material in the container. In various embodiments, the vertical motion of the tamper begins from a position within the filler directly above the container.

The tamper may move into a position directly above the container from a position where its presence does not impact operation of the filler filling the container. For instance, this position may be beside, above, and/or external to a path of material traveling through the filler to the container.

In accordance with one aspect of an exemplary embodiment of the invention, a device for filling a container with a material includes a conduit comprising a top opening and a bottom opening, and a tamper integrally coupled to the conduit. The tamper may be configured to move laterally from a first position to a second position. In various embodiments, the first position is out of the path of material moving through the filler. The second position may be substantially directly above a filled container. Though it may take any path to move from the first position to the second position, preferably, the tamper generally travels in a straight, horizontal path. In this context, horizontal generally refers to along x and y axes in a Cartesian coordinate system.

Upon arrival at the second position, the tamper is ready to tamp the material previously filled in the container. The tamping face of the tamper is configured to tamp the material in the container using a vertical tamping motion. In this context, vertical generally refers to along the z axis in a Cartesian coordinate system.

In various embodiments, to reduce spillage, a shape of the bottom opening may be configured to mirror a shape of an opening of a container.

These and other features and advantages of the present invention will become apparent to those skilled in the art upon a reading of the following detailed description when taken in conjunction with the drawing figures, wherein there is shown and described various illustrative embodiments of the invention.

BRIEF DESCRIPTION OF THE DRAWING FIGURES

The subject matter of the present invention is particularly pointed out and distinctly claimed in the concluding portion of the specification. A more complete understanding of the present invention, however, may best be obtained by referring to the detailed description and to the claims when considered in connection with the drawing figures, wherein like numerals denote like elements and wherein:

DETAILED DESCRIPTION

The present invention provides for significant advancements over prior art processes, particularly with regard to process efficiency, process economics, and reduction of material arriving in an unintended positioning. For instance, the present system results in filled containers with the material compressed strait down towards the base of the container. After use of the present system, these filled containers are generally ready to receive a lid and other packaging for sale.

Moreover, existing tray filling systems, in many instances, may easily be retrofitted to exploit the many commercial benefits the present invention provides. As mentioned above, the present system reduces spilling of material outside of the container. Additionally, though down-stream tampers may be used with the present system, they are not likely to be implemented as the present system can perform their function. These and other exemplary aspects of the present invention are discussed in greater detail herein below.

Figure 1A:
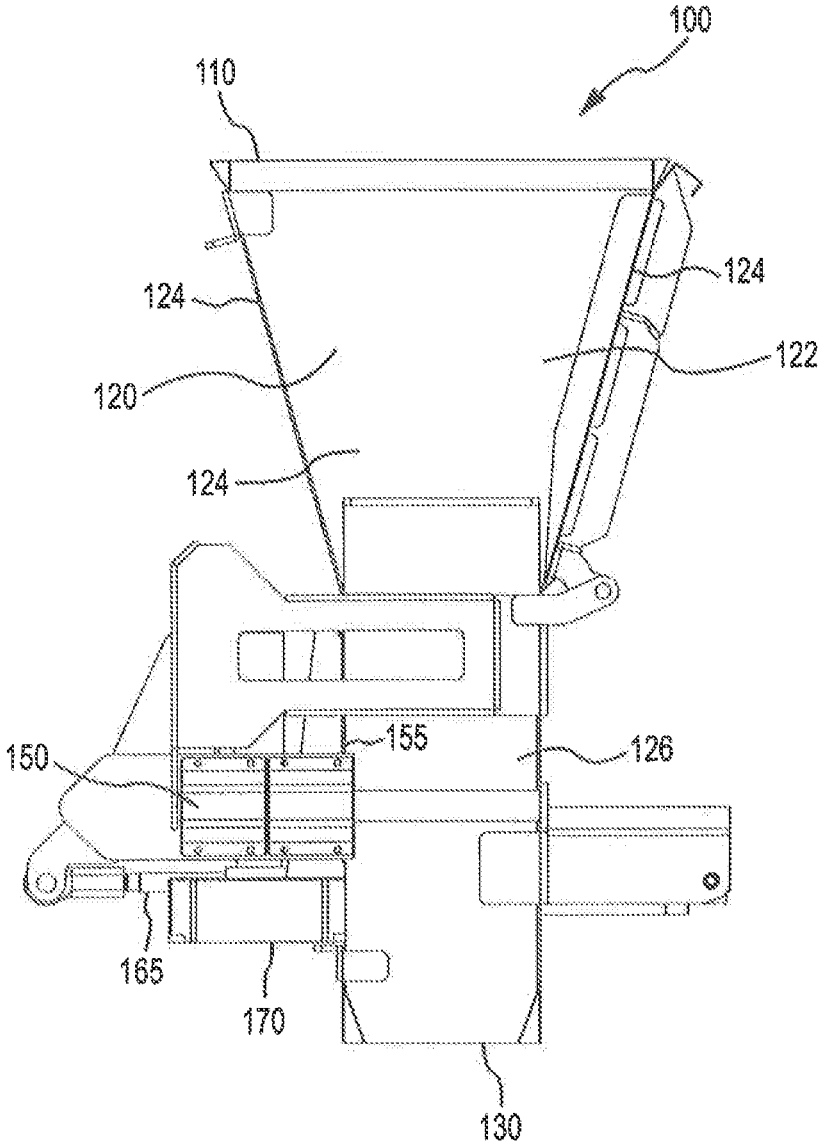
FIG. 1A illustrates a profile view of an integral vertical tamping system in accordance with one embodiment of the present invention.
Figure 1B:
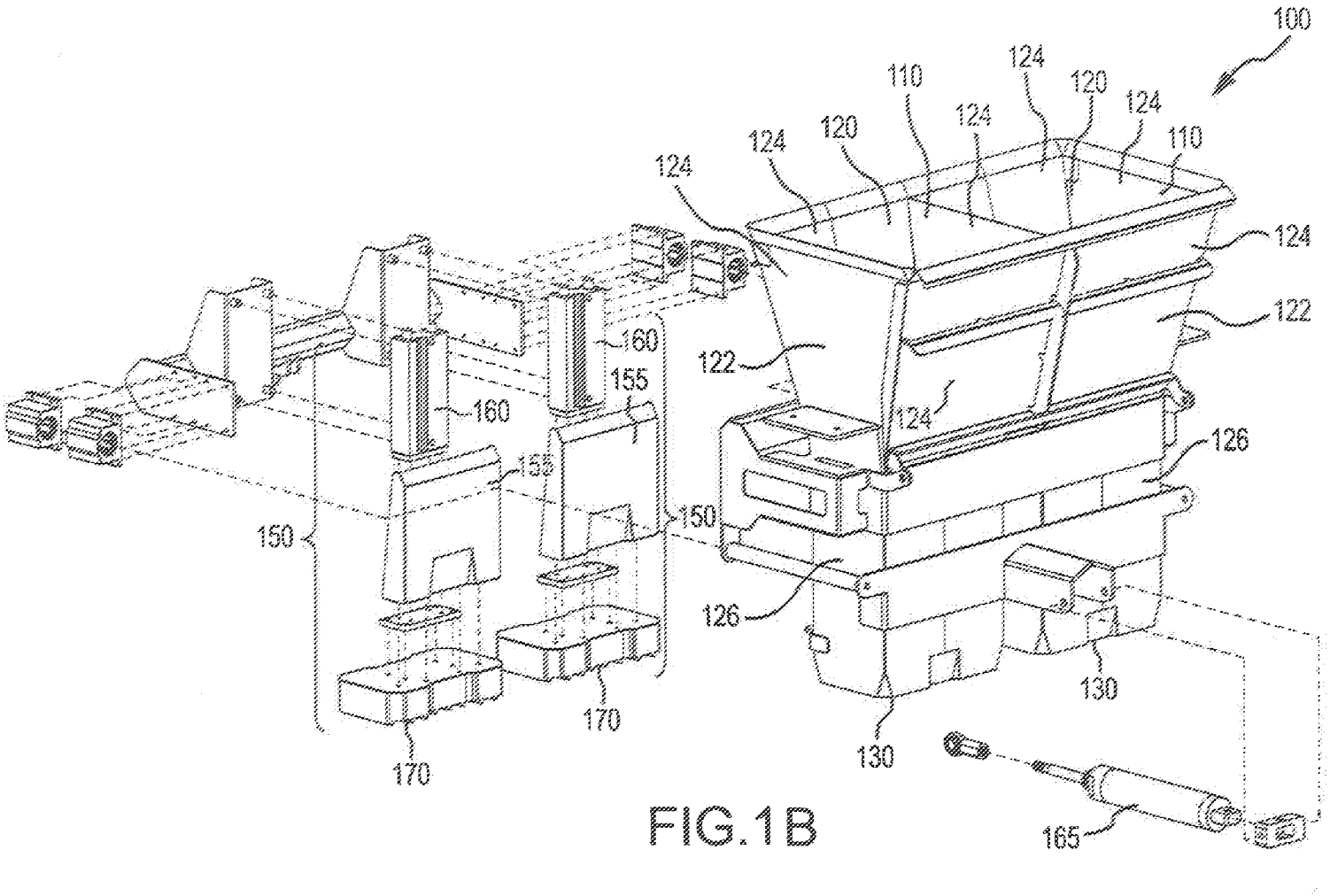
FIG. 1B illustrates an exploded perspective view of the integral vertical tamping system of FIG. 1A in accordance with one embodiment of the present invention.

With initial reference to FIGS. 1A-1B, an integral vertical tamping system 100 illustrating various aspects of an exemplary embodiment of the invention is provided. Integral vertical tamping system 100 generally comprises a conduit 120 configured to deliver material 102 (e.g. product) to the desired location. Material 102 may be any type of material, such as an edible material. For instance, material 102 may be a fruit or vegetable, such as lettuce, spinach, kale, spring mix, nuts, figs, dates and/or the like. A reduction in additional structures and moving parts within this conduit 120 is beneficial so that the material 102 does not become temporality delayed on these structures on its way through conduit 120. This conduit 120 comprises a top opening 110 for receiving material 102 and a bottom opening 130 for directing material, generally to an awaiting container. Integral vertical tamping system 100 also comprises an integral tamper 150. Once material 102 is filled in the container, tamper 150 moves from a first position which will not obstruct material 102 moving through the conduit 120 to a second position generally directly above the container opening for tamping. In this way, the tamper can tamp the material in a downward motion. This downward tamping compresses the material straight down towards the bottom of the container, rather than to the middle or sides of the container.

In various embodiments, top opening 110 may be any suitable shape, such as rectangular, square, rounded, ovoid and/or the like. Generally, this shape is determined based on the feeding system and/or hopper used to deliver material 102 to the filler 100. Top opening 120 should be large enough such that material being fed into top opening 120 does not spill over or around the edge of top opening 120. With reference to FIG. 1B, top opening 110 generally comprises a rectangular cross section. In various embodiments, the meeting of the edges of the interior walls of conduit 120 may be slightly rounded to reduce material 102 becoming trapped or caught in the corners.

Conduit 120 may be any suitable shape. For instance, conduit 120 may be an open chute which connects top opening 110 to bottom opening 130. Conduit 120 may be made from any suitable material. For example, conduit 120 may be made from a durable material which may be cleaned and sanitized with ease. Preferably, conduit 120 is primarily made of stainless steel. Also, conduit 120 may be made from a material configured to reduce material 102 dragging on or sticking to, such as via suction, its interior side walls. For example, portions of conduit 120 may be made from a rigidized metal, such as welded rigidized stainless steel configured in a pattern, such as a 7DL pattern.

In accordance with one aspect of the invention, with further reference to FIGS. 1A-1B, conduit 120 may taper from a wide mouth (e.g. top portion 122) at top opening 110 to a more narrow section, such as conduit bottom portion 126. This aids in receiving and directing material to a precise location, such as within a container.

With renewed reference to FIGS. 1A-1B, in accordance with one aspect of the invention, though it could be any suitable shape, conduit bottom portion 126 may comprise a rectangular cross section. Though they may have any orientation and be set at any angle, in an exemplary embodiment, conduit bottom portion 126 may comprise two sets of substantially parallel walls. This orientation of conduit bottom portion 126 may reduce material 102 clogging conduit 120. In an exemplary embodiment, at least a portion of at least one of parallel wall may comprise a side face 155 of integral tamper 150. The bottom of conduit bottom portion 126 may be bottom opening 130.

Bottom opening 130, may comprise any suitable shape. For instance, in an exemplary embodiment, bottom opening 130 may be shaped to mirror the shape of an opening of a container. Bottom opening 130 may be suitably shaped such that its outer surface is slightly smaller than, matches or is slightly larger than the opening of a container.

In an exemplary embodiment, conduit bottom portion 126 and/or a portion of bottom portion 126 may be removed from system 100 and replaced with a second conduit bottom portion 126 with larger or smaller dimensions suitably shaped to correspond with the shape and dimensions of a provided container. In various embodiments in accordance with aspects of the invention, conduit bottom portion 126 may be configured to receive a semi-permanent adapter suitably shaped to correspond with the shape and dimensions of a provided container. This adapter may reduce the size of conduit bottom portion 126 to a smaller shape or modify the shape of conduit bottom portion 126 to substantially mirror the respective shape of a provided container, as desired.

In accordance with one aspect of the invention and with reference to FIG. 1B, a tamping unit, such as integral tamper 150, may comprise a tamper housing 160, and a tamping face 170. Tamping face 170 may be configured for making contact with, compacting and/or compressing material 102 delivered to a container. Additionally, though it may be moved by any suitable means, in various embodiments, integral tamper 150 comprises a tamping piston 180 configured to move tamping face 170. For instance, tamping piston 180 may be configured to move tamping face 170 away from and towards tamper housing 160.

Though a piston is depicted and described, it is understood that any modality of moving tamping face 170 from a compressed position to an extended position in a substantially vertical motion may be utilized. For instance, tamping face 170 may be pulled, dropped and/or pushed into position (from a compressed position to an extended position and/or vice versa). This movement may be accomplished via mechanical, fluid, electrical, pneumatic, and/or magnetic operation. The compressed position refers to tamping face 170 which is not extended from tamper housing 160 by tamping piston 180.

Also, in various embodiments, though it may be moved by any suitable means, integral tamper 150 may be coupled to a housing piston 165 configured to move tamper housing 160. Though this motion may be in any suitable direction, preferably, this movement is in the horizontal direction along a substantially horizontal plane.

Though a piston is depicted and described, it is understood that any modality of moving tamper 150 and tamper housing 160 from the first position to the second position, such as in the substantially horizontal plane, may be utilized. For instance, tamper 150 and tamper housing 160 may be pulled, pushed, dropped, lifted, or rotated into position from the first position to the second position. This movement may be accomplished via mechanical, electrical, pneumatic, fluid and/or magnetic operation. This tamper 150 operation and movement will be described in greater detail below.

As noted above, in various embodiments, such as an embodiment where tamper 150 is positioned outside of conduit 120 while material 102 is traveling through the conduit 120, portions of integral tamper 150, such as side face 155, may comprise portions of conduit 120.

Tamper housing 160 may comprise circuitry and/or a controller for operating tamper 150. Tamper 150 may be configured such that tamping face 170 may be extended and compressed from tamper housing 160. For instance, tamper housing 160 may be coupled to tamping piston 180. Tamping piston 180 may be coupled to tamping face 170. In response to a received signal, tamping face 170 may be extended from a compressed first position to an extended position or a partially extended position via operation of tamping piston 180. Thus, tamping face 170 will move from a position near tamper housing 160 to a position away from tamper housing 160 depending on the length, stroke, and operation of tamping piston 180.

Tamping piston 180 may be a mechanical actuator, such as hydraulic cylinder with mechanical, electronic, fluid and/or pneumatic operation. The controller may control the force, speed, distance, and/or acceleration of tamping piston 180. These variables may be controlled in response to material 102 being delivered by integral vertical tamping system 100. Thus, tamping face 170 may be programed to travel deeper into a container or with greater force as desired. For instance, tamping face 170 may be programed to travel deeper into a container or with greater force based on the type volume and/or condition of material 102 being tamped.

Also, in an exemplary embodiment, tamping face 170 may optionally be programed to clear debris (e.g. material 102) from the interior walls of conduit 120 but not make contact with material 102 delivered to the container. In this embodiment, tamping face 170 may be fitted with an adapter configured to clear material 102 from conduit 120. This functionality may be programed to occur on a periodic basis such as after each container is filled or after a set number of containers are filled and/or be called upon on an ad hoc basis, such as initiated by a user. Optionally, in various embodiments, the operation of tamper 150 may be temporarily disabled.

As mentioned above, in accordance with one aspect of the invention, tamper housing 160 may be coupled to housing piston 165. Housing piston 165 may be coupled to integral vertical tamping system 100. Housing piston 165 may be a mechanical actuator, such as hydraulic cylinder with mechanical, electronic, fluid, or pneumatic operation. Housing piston 165 may comprise and or be coupled to circuitry and/or a controller for operation. Housing piston 165 may move tamper housing 160 from a first position to a second position and vice versa. In general, this movement is along a horizontal plane. Thus, in practice, tamping face 170 along with tamper housing 160 (generally in a compressed orientation) move from a first position to a second position along a horizontal plane. Then, tamping face 170 moves from its compressed orientation to an extended orientation in a substantially vertical plane.

The controller may control the timing of movement, speed, and/or range of movement of housing piston 165. These variables may be controlled in response to material 102 being delivered by integral vertical tamping system 100. Thus, tamping face 170 may be programed to travel deeper or shallower into a container or with greater or less force based on the type, volume and/or condition of material 102 being tamped. Optionally, the operation of the housing piston 165 may be temporarily disabled. In this way, material 102 may be filled by integral vertical tamping system 100 without tamping. Thus, there is no delay for moving tamping housing 160 from the first position to the second position and back between material 102 being filled into each newly indexed container.

Figure 2A:
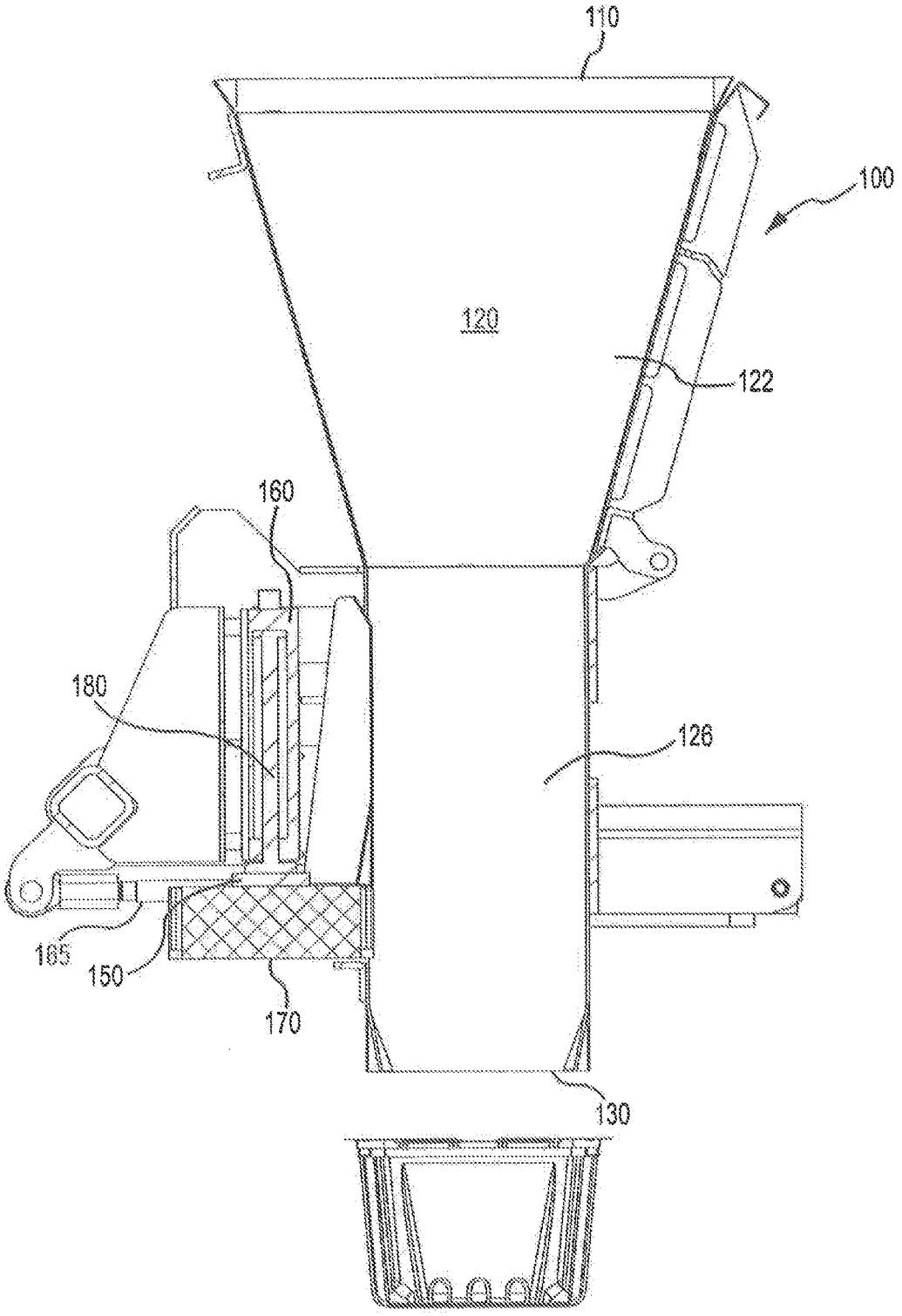
FIG. 2A illustrates a profile view of the integral vertical tamping system of FIGS. 1A and 1B in accordance with one embodiment of the present invention where the integral tamper is compressed is in a first position which will not obstruct material traveling through the conduit.

In accordance with one aspect of the invention, coupled to tamping face 170 (or a portion of tamper housing 160) is tamper 150 side face 155. When tamper housing 160 and tamping face 170 is in a first position, the exterior of side face 155 may comprise a portion of an interior wall of conduit 120. With reference to FIGS. 2C-2E, conduit 120 may be shaped, such as with a cut-out to receive side face 155. In this way, with tamper 150 in the first position, the adjacent interior walls of conduit 120 are generally even with side face 155. Also, the orientation of side face 155 may be configured such that there are minimal gaps between the edges of side face 155 and the cut-out edges of conduit 120. Aspects of side face 155 may be shaped relative to a provided container and/or surface features of the interior conduit 120 wall opposite side face 155. For instance, side face 155 may be shaped to mirror an indentation or notch in conduit 120 wall opposite side face 155. Also, side face 155 may be shaped such that surface features of the wall opposite side face 155 do not impede the extension of the tamping face 170. Side face 155 may be made of any suitable material and/or combination of materials. For instance, the upper portion of side face 155 may be made from rigidized metal such as rigidized metal configured in a pattern, such as a 7DL pattern, and the lower portion of side face 155 may be made from a molded plastic.

Figure 3A:
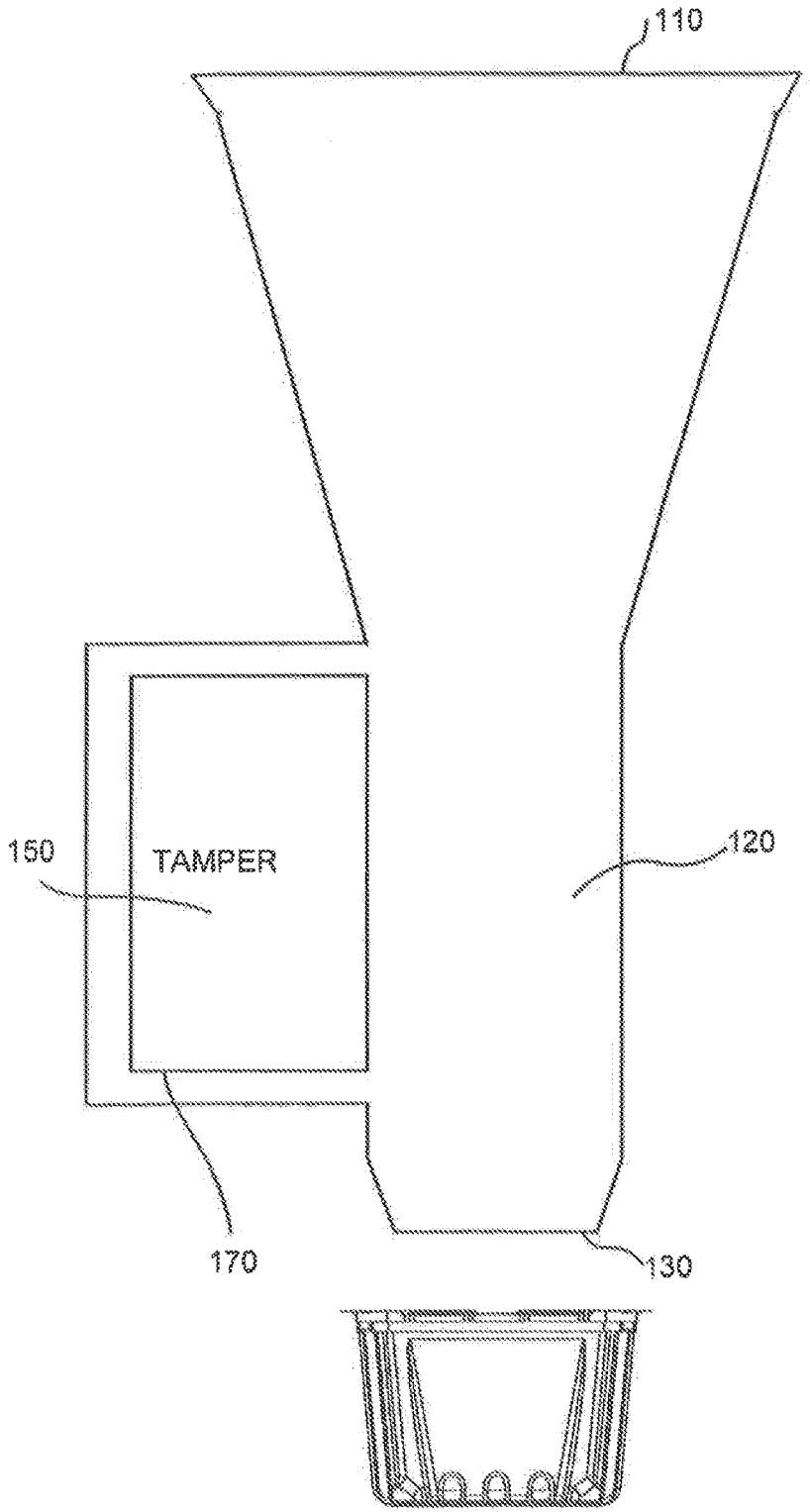
FIG. 3A illustrates a profile view of the integral vertical tamping system in accordance with one embodiment of the present invention where the integral tamper is located in a first position which will not obstruct material traveling through the conduit.
Figure 3B:
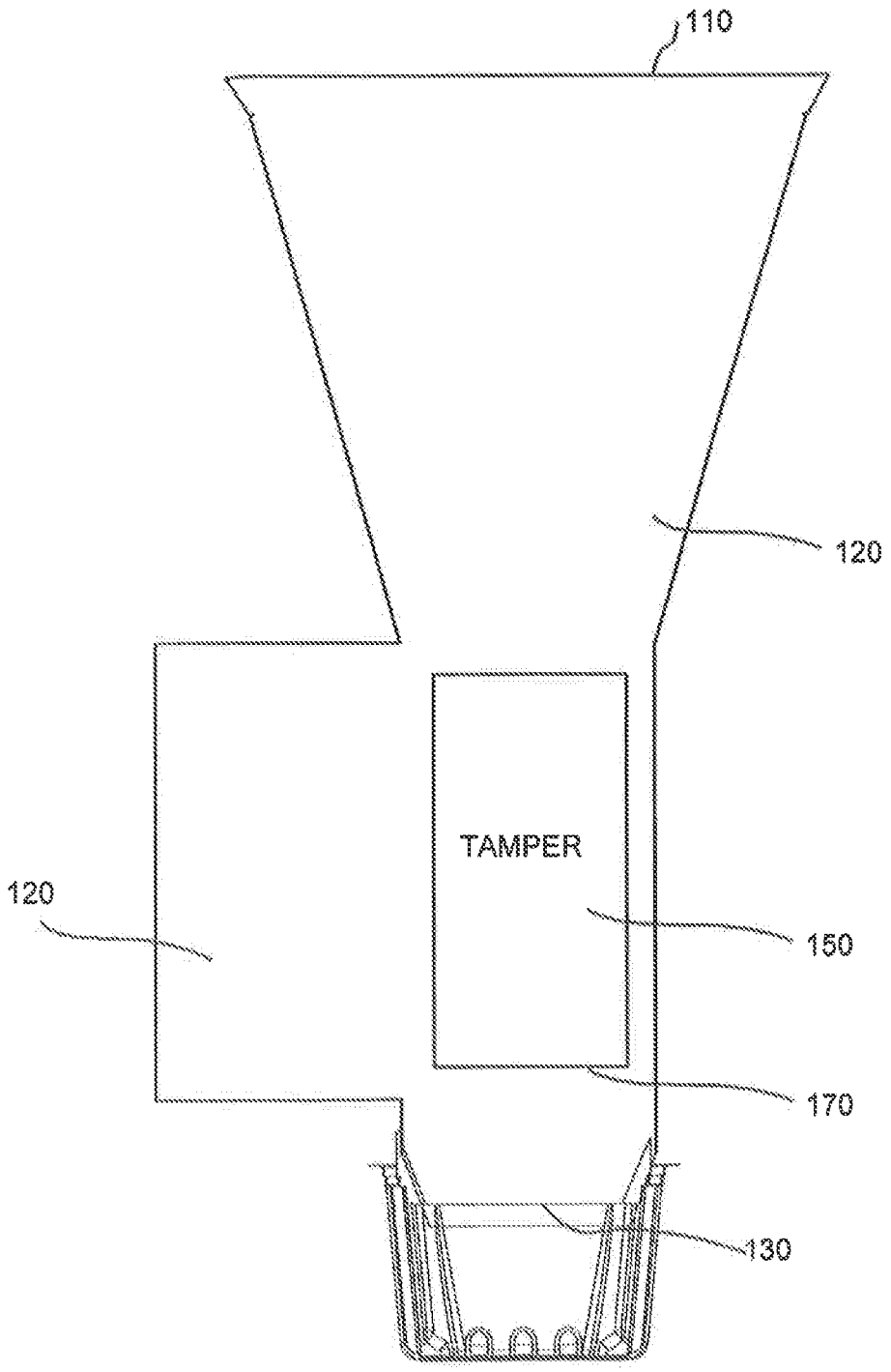
FIG. 3B illustrates a profile view of the integral vertical tamping system of FIG. 3A, where the integral tamper moved to a second position in the conduit directly above a container.
Figure 3C:
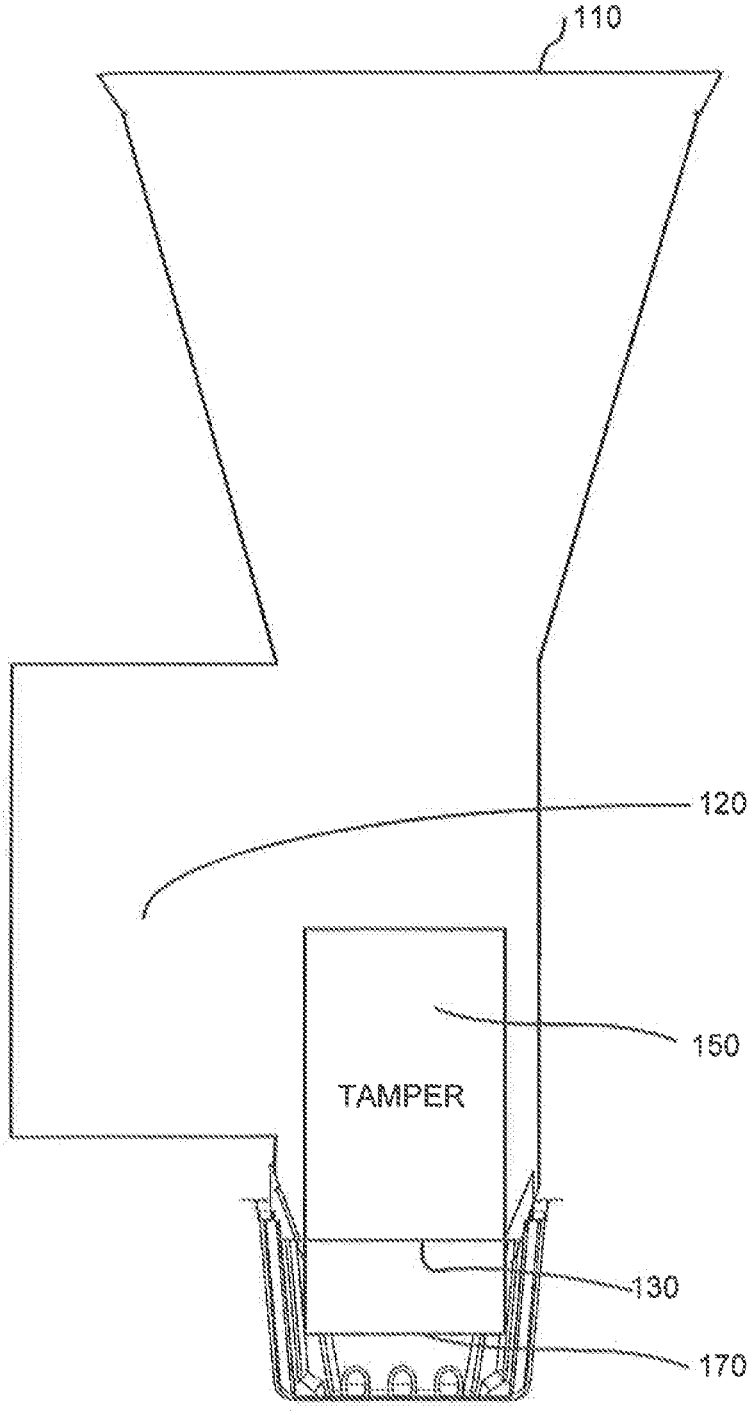
FIG. 3C illustrates a profile view of the integral vertical tamping system of FIGS. 1A and 1B, where the tamper is extended for tamping material (not shown) within the container.

In accordance with various embodiments, side face 155 of tamper 150 may not comprise a portion of conduit 120. In this embodiment, tamper 150 moves into and/or is oriented in the second position over the container for tamping from a first position where it does not impede material 102 traveling through conduit 120 to the container. For instance, in an exemplary embodiment, and with reference to FIGS. 3A-3C tamper 150 may be located within conduit 120 but, due to surface features and/or mechanical aspects of conduit 120, not impact delivery of material 102 to the container. Tamper side face 155 may aid in directing material 102 through conduit 120. Alternatively, other features of filler 100 may aid in directing material 102 through conduit 120. These features may comprise a removable partition, a door, flap, and/or deflector.

Figure 4:
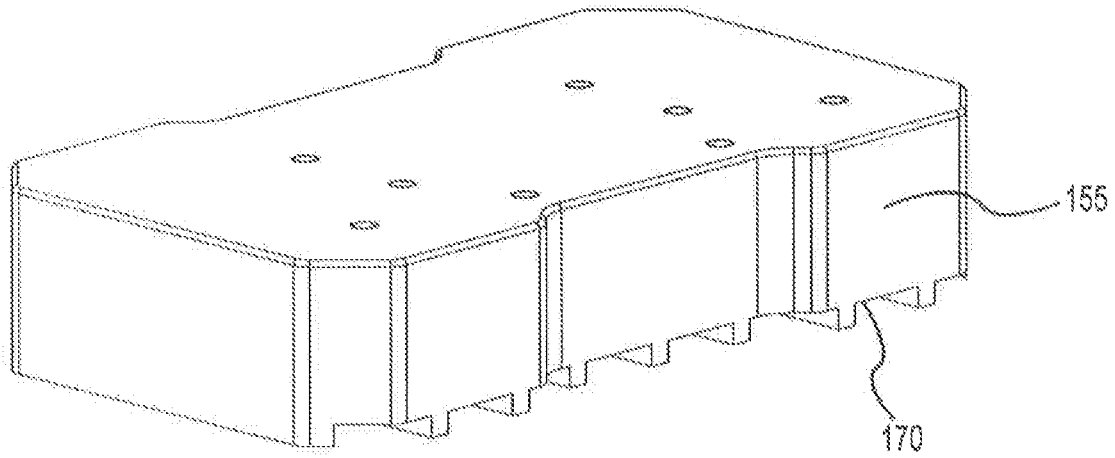
FIG. 4 illustrates a perspective view of a tamper face in accordance with one embodiment of the present invention.
Figure 5:
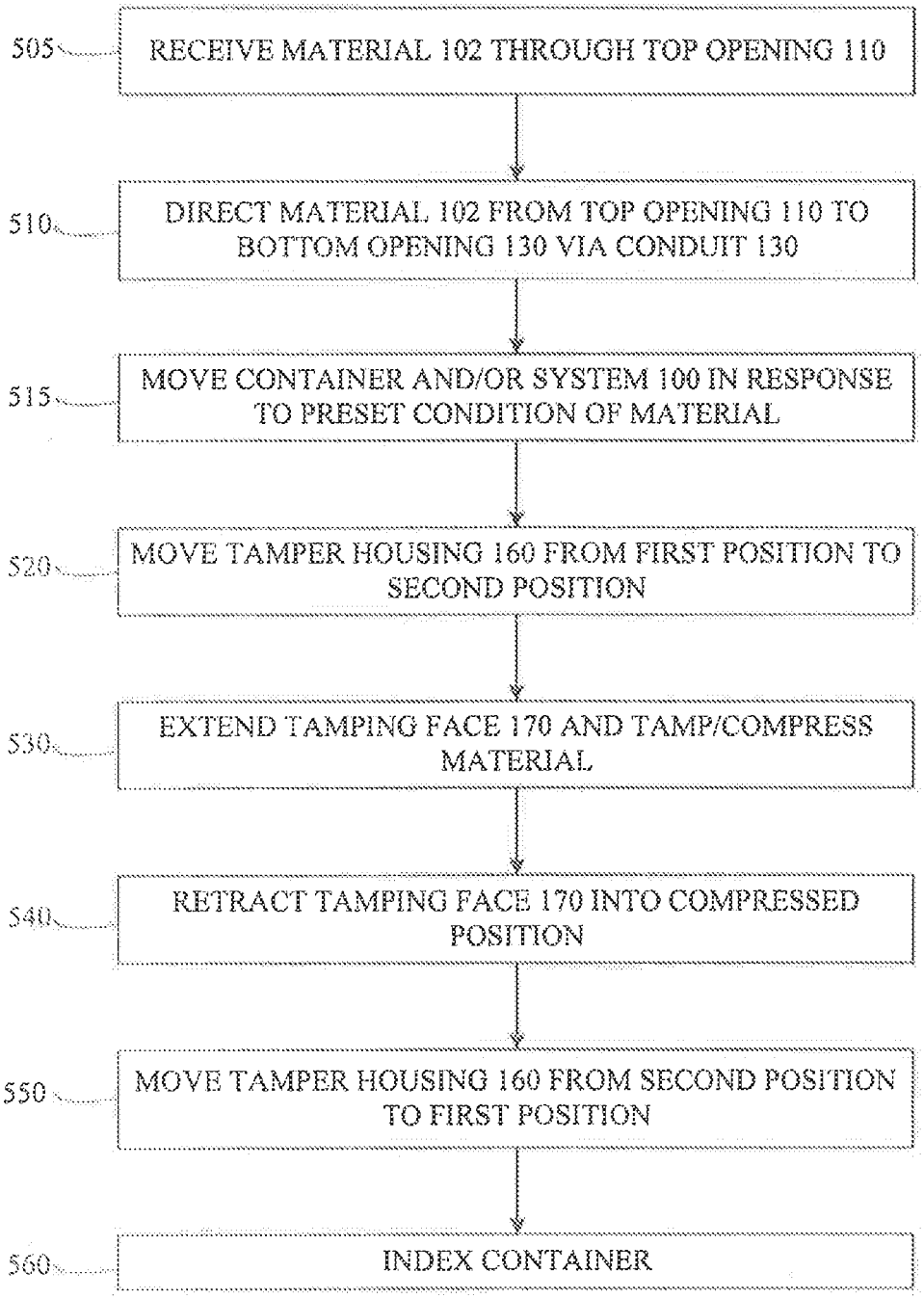
FIG. 5 illustrates a flow chart of an exemplary embodiment the operation of the system.

In accordance with one aspect of the invention and with reference to FIG. 4, tamping face 170 may have any suitable shape. In an exemplary embodiment, tamping face 170 may comprise a generally rectangular cross section. It may be desirable that tamping face 170 be made such that its outer dimensions are as near the dimensions of the interior walls of conduit 120, bottom opening 130, and/or the opening/interior dimensions of the container. For instance, the face, edges and sides of tamping face 170 may be shaped to mirror the interior walls of conduit bottom portion 126 and/or bottom opening. In an exemplary embodiment, tamping face 170 may be shaped to mirror the shape of an opening of and/or interior shape of a provided container.

In an exemplary embodiment, tamping face 170 may comprise surface features designed to reduce material 102 sticking to elements of tamper 150. As discussed above, tamping face 170 may be configured to make contact with and/or compress material 102. Tamping face 170 and portions of tamper 150 may be made from any suitable material, such as a polymer. For instance, for ease of construction and/or to aid with sanitation, tamping face 170 may be made from molded plastic. Tamping face 170 and/or tamper 150 elements may be coupled to tamping piston 180 by any known coupling means. If desired, tamping face 170 may be conveniently removed for repair, replacement or swapped with a tamping face 170 comprising alternative properties, such as made from a different material, made with different surface properties, and/or made with a different shape, for instance to correspond to a different provided container.

In various embodiments, with renewed reference to FIGS. 1A-1B, the aforementioned elements of integral vertical tamping system 100 may be duplicated, presenting an integral vertical tamping system 100 with a pair of conduits 120 coupled side-by-side both having integral tampers 150. These systems may be fed with material 102 by a system, such as a filler box and/or hopper. The integral tampers 150 of the respective conduits 120 may be configured to move from a first position to a second position in tandem, as depicted, or they may be configured to move from the first position to the second position independently of each other with individual housing pistons 165 coupled to each respective tamper housing 160.

In accordance with one aspect of the invention and with reference to FIGS. 2A-2D and FIG. 5, in operation, an apparatus or system, such as a filler box, hopper and/or filling system, comprising material 102 may deliver the material 102 to vertical tamping system 100 (step 500). Though this delivery may be accomplished in any suitable fashion, most preferably, the filling system is oriented substantially above integral vertical tamping system 100 and drops material 102 into tamping system 100 through top opening 110. In various embodiments, the filler box may toggle between each top opening 110 of tamping system 100 and angle its delivery of material 102 to each conduit 120 of integral vertical tamping system 100.

Integral vertical tamping system 100 receives material 102 through top opening 110 (step 505). Material 102 may be dropped through conduit 120 via gravity. Material 102 is then directed towards bottom portion 126 of conduit 120 (step 510). For instance, using the angled surface features, such as angled side walls 124, of top portion 122 of conduit 120, material 102 is directed towards bottom portion 126 of conduit 120.

In an exemplary embodiment, material 102 is dropped in response to a timing scheme, programing and/or sensors indicating a container is positioned to receive material 102 substantially under integral vertical tamping system 100. In various embodiments, positioned to receive material 102 may refer to the opening of the container being substantially in line with bottom opening 130.

In an exemplary embodiment, in response to programing and/or sensors indicating material 102 is ready to be, is being and/or has been dropped, a container is positioned to receive material 102 substantially under integral vertical tamping system 100 (step 515). In accordance with one aspect of the invention and with reference to FIG. 2B, the integral vertical tamping system 100 may be automatically and/or manually moved up or down with respect to a container, the container may be automatically and/or manually mechanically moved up to, around, or in a portion of integral vertical tamping system 100 and/or the container may be automatically and/or manually positioned under integral vertical tamping system 100 such as by advancement of a conveyer belt. Also, the conveyer belt may be configured to automatically and/or manually move up or down, as desired.

Material 102 passes through conduit 120 and is delivered to bottom opening 130. Integral vertical tamping system 100 is configured to direct material 102 through bottom opening 130 into an awaiting container. Preferably, there is as little gap as possible or no gap between the container and the integral vertical tamping system 100. Thus, so that material 102 in the container does not make unintended contact with a surface or an edge of integral vertical tamping system 100 and/or to aid with placing a lid on the container, material 102 in the container is compressed via tamper 150.

In an exemplary embodiment, in response to material 102, such as a leafy vegetable, being dropped through conduit 120, housing piston 165 is provided a signal to move tamper housing 160 from the first position to a second position (step 520). The movement of housing piston 165 may be triggered by programming, sensor or electronic notification. For instance, the timing of the duration of material dropping from a filler box to bottom opening 130 may be known, calculated or observed. Based on this timing, conduit 120 is ready to receive tamper 150 and may be obstructed (by tamper 150) as material 102 has already passed through. Stated another way, the first position of tamper 150 is generally outside of the path of material 102 dropping within conduit 120. This position may be outside or inside of conduit 120. While the tamper 150 is traveling from the first position to the second position, tamping face 170, which makes contact with material 102 during the tamping, may be oriented in any desired orientation. In accordance with one aspect of an exemplary embodiment of the invention, tamping face 170 is oriented in the downward direction, generally normal to the horizontal path of travel of tamper 150 from the first position to the second position. When tamper 150 is in the second position, it is generally positioned for operation in a vertical line with the container, preferably directly over the container opening. Tamper 150 may travel in any path from the first position to the second position; however, as the time tamper takes to arrive at the second position will effect productivity, a short travel path is generally preferred.

Different material 102 and/or conditions of the material 102, (e.g. dry or wet) may affect material 102 drop times through conduit 120. The operation the system 100, such as a the operation of a conveyer belt indexing containers, housing piston 165, and the like, may be calibrated based on these drop times. As stated above, in various embodiments, the motion of tamper housing 160 is generally in a short path of travel, more preferably, generally along a horizontal plane. Preferably, when tamper housing 160 is in the first position, the tamper housing 160 is out of the path of material 102 traveling through conduit 120, such as exterior to conduit 120. Thus, the tamping face 170 and tamper housing 160 do not impede material 102 passing through conduit 120 when tamper housing 160 is in the first position. In various embodiments, not depicted, tamper 150 may be interior to the conduit 120 so long as its placement and/or features of the conduit allow for material 102 to travel to container without being impleaded by tamper 150.

With renewed reference to FIGS. 2C and 2D, preferably, in accordance with the various aspects of the present invention, material 102 in the container (not shown) is suitably compressed through operation of tamping system 100.

In general, tamping unit comprising tamping face 170 is moved from a first position, such as a first position outside an opening in the conduit 150, to a second position generally covering the opening of the container and then at least the tamping face 170 moves to a third position. Preferably, movement of the tamping face 170 from the second position to the third position suitably compresses material 102 such that further efforts to compress material 102 or attend to spillage are unnecessary.

In a typical embodiment, where material 102 comprises leafy material, tamping face 170 and/or container are suitably moved during tamping such that tamping face 170 is within about ½ to about 3 inches from the bottom of the container, more preferably on the order of about 1 to about 2 inches and most preferably about 1.5 inches from the bottom. However, the desired distance may be suitably selected based on a number of factors, including, without limitation the type of material 102, the volume of the container, shape of the container, the condition of material 102, durability of material 102, and/or desired compression of material 102 within the container.

In accordance with an embodiment, in response to tamper housing 160 arriving at the second position, a signal is sent to tamping piston 180 to move tamping face 170 from a compressed position to an extended position (step 530). Though this may be in any suitable path, preferably, this motion is generally along a vertical plane. As tamping face 170 is extended, such as extended away from tamper housing 160, tamping face 170 makes contact with material 102. The stroke of tamping piston 180 may be its full range of motion or less than the full range of motion of tamping piston 180. For instance, tamping face 170 is extended between about 4 and 10 inches, more preferably on the order of about 5 to about 8 inches and most preferably about 6 inches. This results in tamping face 170 being about 1.5 inches from the base of the interior of the container. The preferable stroke distance is a balancing between a short stroke for efficiency against clearing/not making contact with a non-compressed (e.g. fluffed up) mound of material 102 in the container extending up into conduit 120 while tamper 150 moving horizontally. Additionally, as tamping face 170 is extended, tamping face 170 may clear material 102 stuck to and/or hung up in the interior of conduit 120. Thus, as tamping face 170 is extended, tamping face 170 is configured to move within at least two interior walls of conduit 120. In accordance with an exemplary embodiment and with reference to FIGS. 2D and 2E, tamping face 170 may be configured to pass through bottom opening 130 and down into the container to compress material 102 within the container as tamping face 170 moves from the compressed position to the extended position (e.g. from the second position to a third position). In a preferred embodiment, the container does not move while the tamper 150 moves from the first position to the second position and/or while the tamper 150 moves from the second position to a third position. Stated another way, in a preferred embodiment, the container does not move between being filled with material 102 and having material 102 tamped by tamper 150.

With renewed reference to FIG. 2C, tamping face 170 may be moved from the extended position to the compressed position (step 540). This motion may be along any path. For instance, in accordance with one aspect of the invention, in response to tamping face 170 arriving at the extended position, a signal is sent to tamping piston 180 to move tamping face 170 from the extended position to the compressed position (step 540). Again, this motion is generally along a vertical plane. In accordance with an exemplary embodiment, tamping face 170 may pass through bottom opening 130 while moving from the second extended position to the first compressed position.

Optionally, a signal may be sent to tamping piston 180 to extend tamping face 170 down conduit 120 a second time, such as to clear material 102 from conduit 120 or to further compress material 102 in the container. This movement may be less than the total range of motion of tamping piston 180, for instance to clear material in conduit 120. As above, a signal may be sent to tamping piston 180 to move tamping face 170 from the extended position to the compressed position. For instance, in response to tamping face 170 arriving at the desired extended position, a signal is sent to tamping piston 180 to move tamping face 170 from the desired extended position to the compressed position.

Figure 2B:
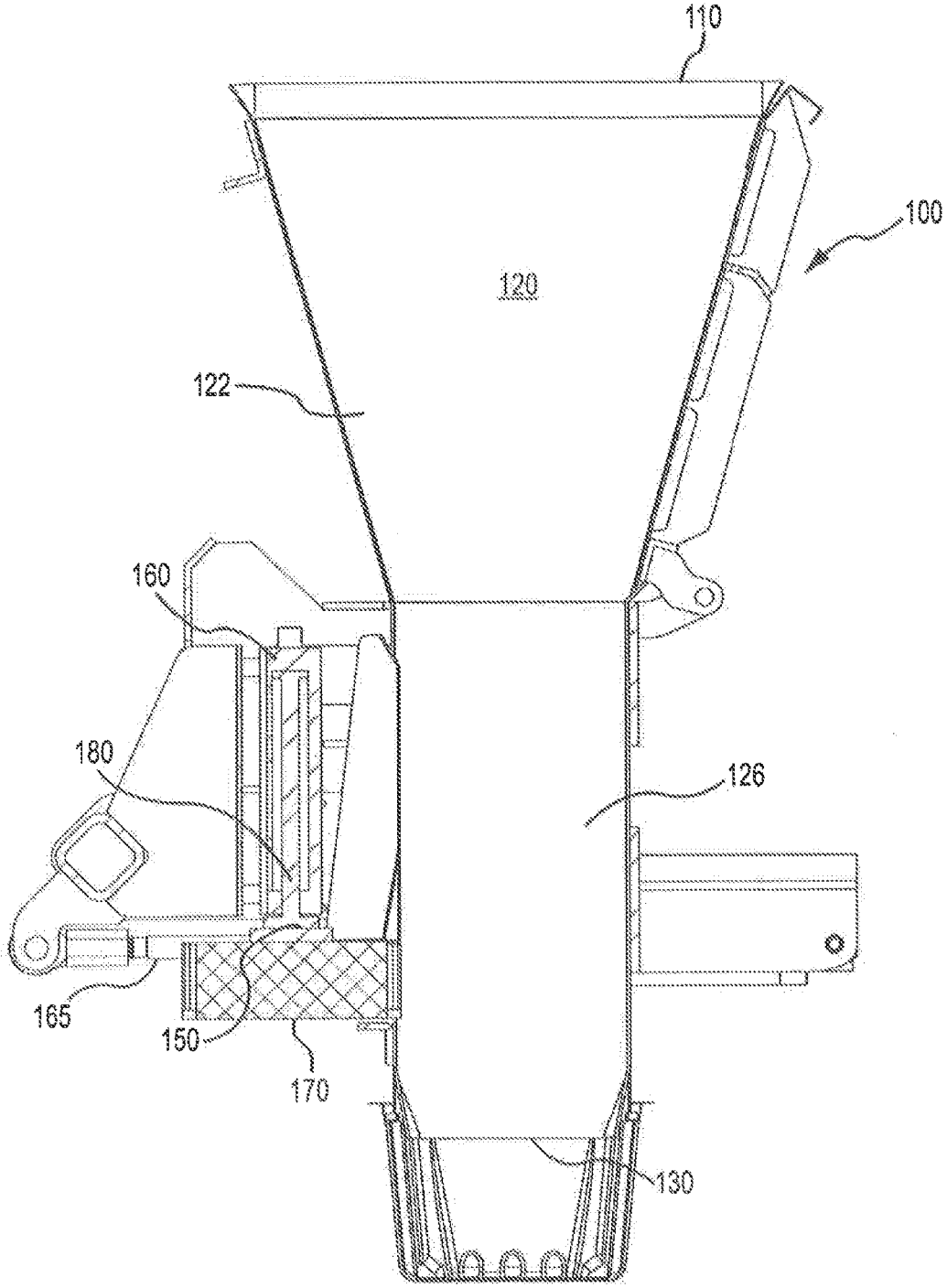
FIG. 2B illustrates a profile view of the integral vertical tamping system of FIGS. 1A and 1B in accordance with one embodiment of the present invention where the integral tamper is compressed is in the first position.
Figure 2C:
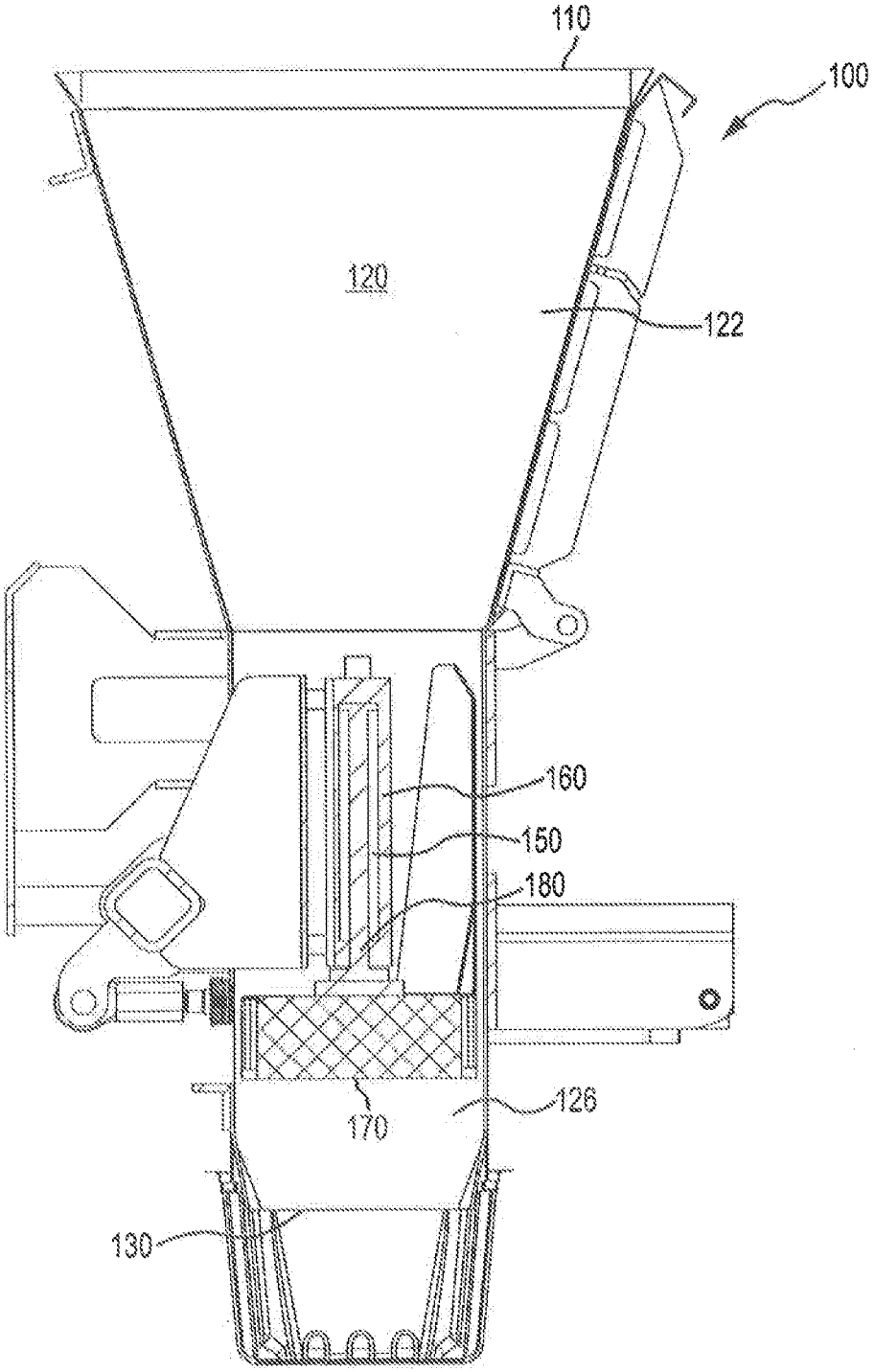
FIG. 2C illustrates a profile view of the integral vertical tamping system of FIGS. 1A and 1B in accordance with one embodiment of the present invention where the integral tamper is compressed and has moved to a second position.
Figure 2D:
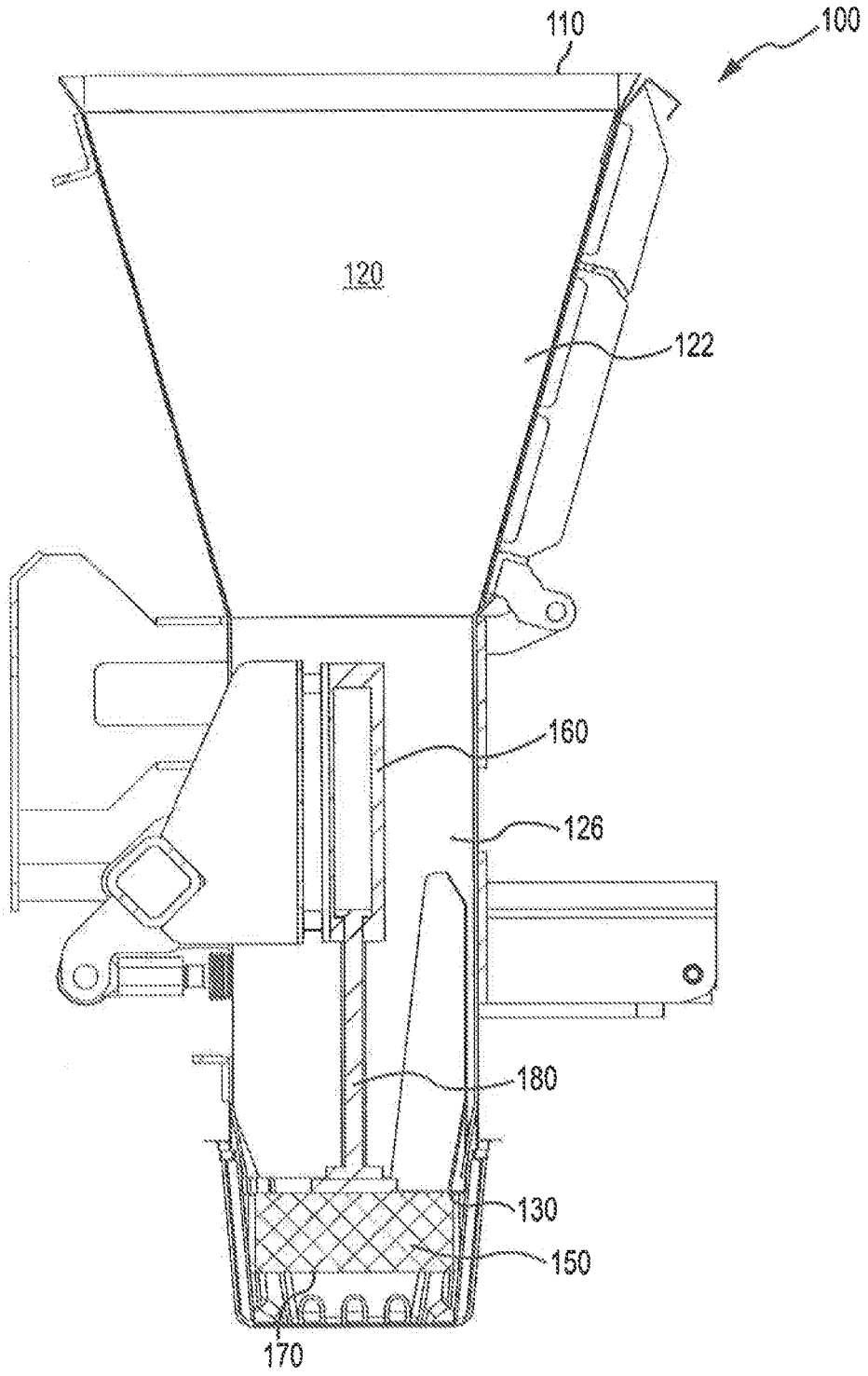
FIG. 2D illustrates a profile view of the integral vertical tamping system of FIGS. 1A and 1B in accordance with one embodiment of the present invention where the integral tamper is extended in the second position.
Figure 2E:
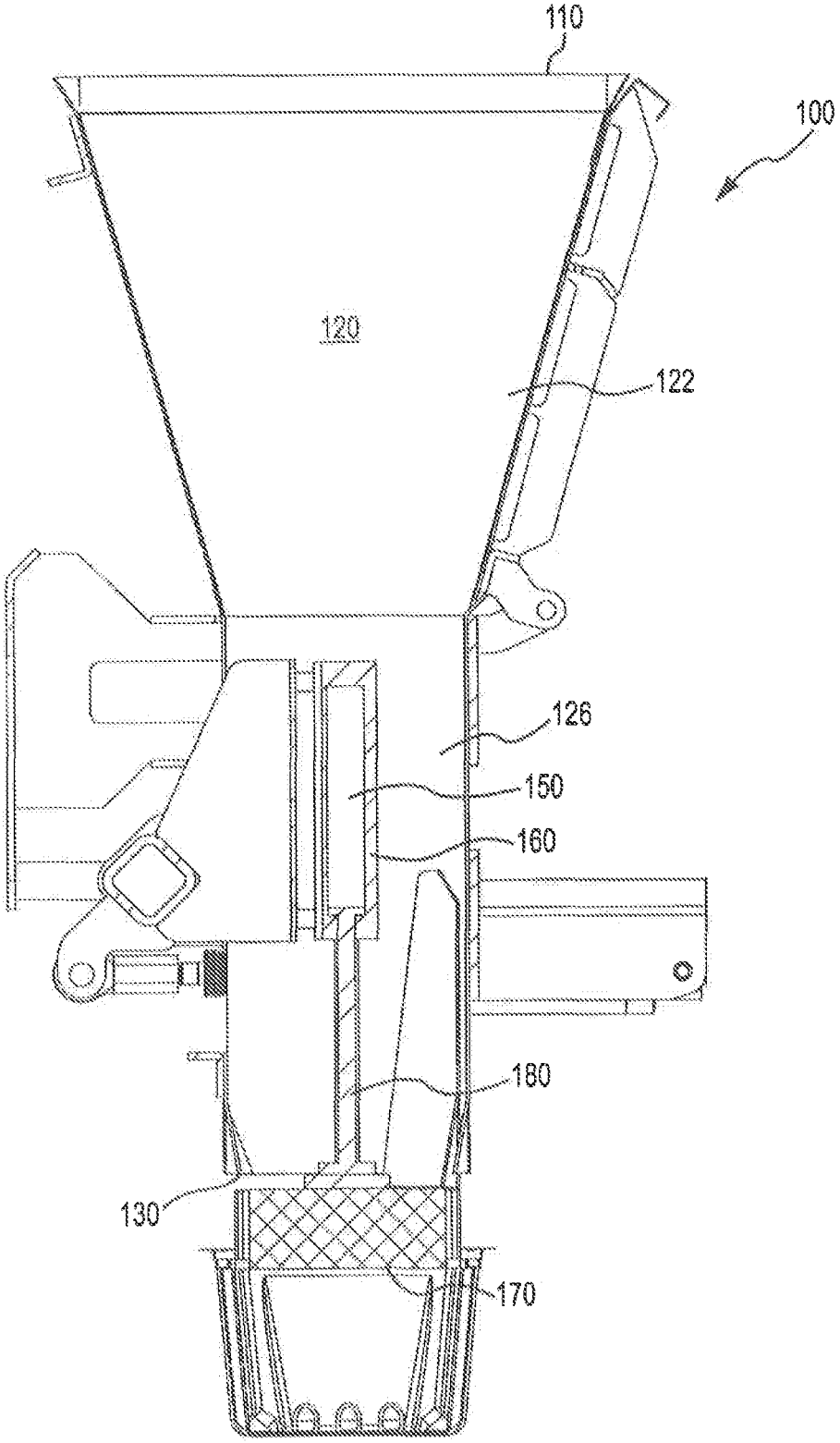
FIG. 2E illustrates a perspective view of the integral vertical tamping system of FIGS. 1A and 1B in accordance with one embodiment of the present invention where the integral tamper is extended in a second position.

With renewed reference to FIG. 2B, tamper housing 160 may be moved from the second position to the first position (step 550). For instance, in response to tamper housing 160 arriving at the second position with tamper face 170 in the compressed orientation, a signal may be sent to housing piston 165 to move tamper housing 160 from the second position to the first position (step 550).

With renewed reference to FIG. 2A, in response to material 102 being compressed in the container and/or tamping face 170 being compressed and/or removed from the container, a signal may be sent to a system responsible for advancing the container to advance the container and place a new empty container or container to be filled with material 102, in position for receiving material 102 by integral vertical tamping system 100 (step 560).

Integral vertical tamping system 100 is well suited for larger and/or heavy loads of material 102 in larger containers. The preferable downward/vertical stroke of the tamper 150 is preferable for these large containers as compared with historical angled tamping approaches. For instance, a large container may be a container suitably sized to hold between about 3 ounces and 2 pounds of material 102, more preferably on the order of about 5 ounces to 1 pound. According to various embodiments, a large container may be a container suitably sized to hold about 5 ounces or about 1 pound. Additionally, larger and/or heavy loads generally take longer to fill the container and are well suited to the horizontal and then vertical tamping motion of the tamper housing 160 and tamper face 170 described above.

One or more controllers may be coupled to integral vertical tamping system 100 configured to control the operation of the moving systems and/or parts. For instance, the timing and coordination of the filler box opening, the indexing of the container, the movement of tamping piston 180 and/or housing piston 165 may be controlled by the controller. These controllers may be preprogrammed and/or controlled by a user via a user interface. For instance, the programing of the system may be stored to a non-transitory computer readable medium and/or memory.

In an exemplary embodiment, not shown, additional tampers may be coupled to integral vertical tamping system 100. For instance, one or more additional tamper configured to roll and/or rotate into position located proximate bottom opening 130. This tamper and/or pair of tampers may be configured to direct their force down and away from the center of the container. This additional tamper may be configured to operate, before, after, and/or independent to tamper 150. For instance, this additional tamper may be configured to operate in lieu of tamper 150.

In an exemplary embodiment, more than one tamper may be integrally coupled to each conduit 120. For instance, two tampers from alternating opposite sides may be moved from a first position external to the interior of the conduit to a second position substantially interior to conduit 120 along a substantially horizontal plane.

In an exemplary embodiment, a single tamper may by integrally coupled to each conduit 120. For instance, this tamper may be configured to move/toggle between a first position within the interior a first conduit and a second position within the interior of the second conduit 120 along a substantially horizontal plane.

In various embodiments in accordance with aspects of the invention, tamper 150 may not require the tamper housing being moved from a first position to a second position. For instance, if the containers are moved into position beneath system 100 pre-filled with material ready for tamping. Additionally, in various embodiments in accordance with aspects of the invention, movement of tamper 150 from the first position to the second position may be temporarily disabled, for instance in the case where system 100 is used to fill containers with a material where tamping is not desired.

The present invention has been described above with reference to a number of exemplary embodiments and examples. It should be appreciated that the particular embodiments shown and described herein are illustrative of the invention and its best mode and are not intended to limit in any way the scope of the invention as set forth in the claims. Those skilled in the art having read this disclosure will recognize that changes and modifications may be made to the exemplary embodiments without departing from the scope of the present invention. These and other changes or modifications are intended to be included within the scope of the present invention, as expressed in the following claims.

The invention claimed is:

1. A method of filling a container and tamping a material within the container comprising:

delivering a first material via a first conduit to a first container, the first conduit comprising a first top opening, a first bottom opening, and a first internal surface;

tamping the first material in the first container by a tamper in a first position, the tamper comprising a tamping face and a tamper side surface oriented orthogonal to the tamping face, wherein a tamping face of the tamper is configured to move laterally along a substantially horizontal path from the first position to a second position, wherein the tamping face is configured to vertically compress the first material in the first container;

delivering a second material via a second conduit to a second container, the second conduit comprising a second top opening, a second bottom opening, and a second internal surface, wherein the second internal surface of the second conduit comprises the tamper side surface in response to the tamper being in the first position;

moving the tamper from the first position to the second position; and tamping the second material in the container by the tamper in the second position, wherein the tamping face is configured to vertically compress the second material in the second container.

2. The method of claim 1, wherein the tamper side surface is configured to mirror the second internal surface of the second conduit.

3. The method of claim 1, wherein the tamping face is configured to clear material from at least one of the first conduit or the second conduit as the tamping face moves vertically for tamping.

4. The method of claim 1, wherein the tamping face is configured to vertically retract post tamping the first material in the first container and post tamping the second material to the second container.

5. A device for filling a container with a material, comprising:

a conduit comprising a top opening, a bottom opening, and an internal surface; and a tamper integrally coupled to the conduit, the tamper comprising a tamping face and a tamper side surface oriented orthogonal to the tamping face, wherein the tamper is configured to move laterally from a first position along a substantially horizontal plane to a second position above the container, wherein the internal surface comprises the tamper side surface as a part of the internal surface in response to the tamper being in the first position.

6. The device of claim 5, wherein the tamper side surface is configured to mirror a respective edge of the bottom opening.

7. The device of claim 5, wherein the tamper side surface is configured to mirror the internal surface of the conduit.

8. The device of claim 5, wherein a shape of the bottom opening is configured to mirror a shape of an opening of the container.

9. The device of claim 5, wherein the tamping face is configured to move vertically for tamping.

10. The device of claim 5, further comprising:

a second conduit configured to deliver the material from a second top opening to a second bottom opening, wherein the second conduit integrally comprises the tamper, wherein the first position comprises the tamper being in vertical alignment with the second bottom opening of the second conduit and the second position comprises the tamper being in vertical alignment with the bottom opening of the conduit.

11. The device of claim 5, further comprising:

a second conduit configured to deliver the material from a second top opening to a second bottom opening; and a second tamper integrally coupled to the second conduit, wherein the second tamper is configured to move from a third position to a fourth position in vertical alignment with a second container, wherein a second tamping face of the second tamper is configured to move vertically for tamping.

12. The device of claim 5, wherein the internal surface of the conduit comprises rigidized metal.

13. The device of claim 5, wherein the tamping face is configured to clear material from the conduit as the tamping face moves vertically for tamping.

14. The device of claim 5, wherein the tamping face is configured to retract vertically post tamping, and wherein the tamper is configured to move laterally along a substantially horizontal plane from the second position to the first position.

15. The device of claim 5, wherein the tamping face is configured to make contact with and compact the material.

16. The device of claim 5, wherein the material comprises at least one of a fruit or a vegetable.

17. The device of claim 5, wherein the material is received through the top opening and delivered via the conduit to the bottom opening.

18. The device of claim 5, wherein the material is delivered via the device to a container via the bottom opening.

19. A device for filling a container with a material, comprising:

a conduit comprising a top portion, a bottom portion, and an internal surface, wherein the top potion is defined by a first angled side wall, a second angled side wall, and a third angled side wall, wherein the second angle sidewall is opposed to the third angled side wall, and wherein the bottom portion comprises a rectangular cross section; and a tamper comprising a tamping face and a tamper side face oriented orthogonal to the tamping face, wherein the tamper is configured to move laterally from a first position along a substantially horizontal plane to a second position within the conduit and above the container, wherein the tamper side face is opposed to the first angled side wall, and the tamper side face defines a portion of the internal surface in response to the tamper being in the first position.

* * * * *